US009251725B2

(12) United States Patent
Raynaud

(10) Patent No.: US 9,251,725 B2
(45) Date of Patent: Feb. 2, 2016

(54) UNIVERSAL TAGGING SYSTEM INCLUDING AT LEAST TWO TAGS

(75) Inventor: Eric Raynaud, Charenton le Pont (FR)

(73) Assignee: ANTHEOR, Paris (FR)

( * ) Notice: Subject to any disclaimer, the term of this patent is extended or adjusted under 35 U.S.C. 154(b) by 0 days.

(21) Appl. No.: 14/125,457

(22) PCT Filed: Jun. 11, 2012

(86) PCT No.: PCT/FR2012/051307

§ 371 (c)(1),
(2), (4) Date: Apr. 15, 2014

(87) PCT Pub. No.: WO2012/168672

PCT Pub. Date: Dec. 13, 2012

(65) Prior Publication Data

US 2014/0215875 A1 Aug. 7, 2014

(30) Foreign Application Priority Data

Jun. 10, 2011 (FR) ..... 11 55135

(51) Int. Cl.
*G09F 3/10* (2006.01)
*G09F 3/02* (2006.01)
*G09F 3/14* (2006.01)

(52) U.S. Cl.
CPC .. *G09F 3/02* (2013.01); *G09F 3/14* (2013.01); *G09F 2003/0222* (2013.01)

(58) Field of Classification Search
USPC ..... 40/638, 674; 283/79–81; 428/40.1
See application file for complete search history.

(56) References Cited

U.S. PATENT DOCUMENTS

| | | | | |
|---|---|---|---|---|
| 1,756,216 | A * | 4/1930 | Seeley | 40/630 |
| 4,577,426 | A * | 3/1986 | Jenkins | 40/638 |
| 4,865,352 | A * | 9/1989 | Gollon | 283/79 |
| 5,165,725 | A * | 11/1992 | Gollon | 283/81 |
| 5,593,025 | A * | 1/1997 | Feibelman | 206/6.1 |
| 6,199,309 | B1 * | 3/2001 | Markarian | 40/299.01 |
| 6,244,431 | B1 * | 6/2001 | VanFleet | 206/6.1 |
| 6,497,063 | B1 * | 12/2002 | Stephens | 40/638 |
| 7,015,815 | B1 * | 3/2006 | Feibelman | 340/572.8 |
| 7,794,809 | B2 * | 9/2010 | Plummer | 428/40.1 |
| 7,854,818 | B2 * | 12/2010 | Plummer | 156/217 |
| 8,458,940 | B2 * | 6/2013 | Davidson et al. | 40/638 |
| 8,467,192 | B2 * | 6/2013 | Stromberg | 361/749 |

FOREIGN PATENT DOCUMENTS

| | | | |
|---|---|---|---|
| EP | 0 316 808 | A2 | 5/1989 |
| FR | 2 754 095 | A1 | 4/1998 |
| FR | 2 927 458 | A1 | 8/2009 |
| JP | 2003-058062 | A | 2/2003 |

* cited by examiner

*Primary Examiner* — Shin Kim
(74) *Attorney, Agent, or Firm* — Sughrue Mion, PLLC

(57) ABSTRACT

System of tagging items that integrates at least two tags of different shapes, each of which can be removed by withdrawing detachable parts. The system includes two flaps connected by a common fold line. The systems also includes a tab that extends longitudinally and is detachably connected along a transverse precut line to one of the flaps on an outer edge thereof, the width of the tab, measured transversely, being smaller than that of the flap.

19 Claims, 6 Drawing Sheets

UNIVERSAL TAGGING SYSTEM INCLUDING AT LEAST TWO TAGS

The invention relates to the domain of tagging of items intended for sale, and more particularly the tagging of jewelry.

The tagging of jewelry is a difficult operation because these items are generally not packaged, and are displayed for sale by simply being disposed on display surfaces.

Their tagging, necessary both for the information of the consumer with respect to the price of the item as well as for the accounting management of the seller during sales transactions (optical reading of a printed code, inputting the price or reference, etc.) or inventory, which cannot be automated and must be done manually, since each item is different in size and shape.

However, there are similarities of shape within the plurality of families of jewelry: necklaces and bracelets generally have a clasp, wristwatches a bracelet, earrings a rod or loop for insertion in the earlobe, pendants a ring for suspension from a chain, and rings are annular.

Within each family, the tagging of jewelry can therefore be accomplished by means of the same tag adapted to the particular shape of the jewelry of that family (for example rings), while being inappropriate to the shape of jewelry of another family (for example earrings).

A simple solution to this problem is to provide a different tag for each family of jewelry. However, this solution is expensive because it requires the manufacture of several types of tags, which on the one hand reduces the quantity required for each type of tag and consequently increases the unit price of each tag, and on the other hand requires a meticulous management of stocks and supplies.

Attempts have been made to make universal a tag medium two different precut tags so that one or the other could be removed as needed, the tags having a common zone comprising an RFID electronic identification device; for example, see French patent FR 2 927 458.

The medium proposed by this document, however, has certain disadvantages.

First, the detachment of a first of the tags intended for tagging rings is difficult because of the length and shape of the cut line defining the tag. The time required to remove this tag is too great with regard to the number of pieces of jewelry to be tagged, which can reach several thousands.

Second, during the detachment of the second tag, intended for tagging medallions, chains and earrings, there is a risk that at least part of the zone common to the two tags would also be detached, which renders both partially torn tags unusable so that they must be discarded. Since each medium is expensive because of the presence of the RFID device, the discard rate must be minimized as much as possible.

Third, because the two tags have only a restricted common zone, the printing of the information intended to be displayed should be:

- either configured to be placed on one or the other of the tags depending on its destination, which necessitates an operation of selecting the print mode insofar as this is permitted by the printing software,
- or limited to the common zone if it is desired to avoid such configuration, which limits the size of the display zone and consequently the amount (or size) of information to be displayed.

Fourth, neither of the two tags is suitable for the direct tagging of wristwatches. In practice, the tagging of a wristwatch is accomplished by means of the second tag, to which a thread knotted around the bracelet of the wristwatch is associated. This operation is long and tedious, and in addition requires additional management of the stock of thread.

A first objective is to make the tagging of the items more efficient, and therefore faster.

A second objective is to limit the tagging rejection rate by limiting the risks of incorrect use.

A third objective is to increase the standardization of tagging, particularly during the printing of information to be displayed.

A fourth objective is to propose a more universal tagging system, that is, one that will enable a larger number of families of items to be tagged directly.

To that end, a system of tagging items is proposed that integrates at least two tags of different shapes, each of which can be removed by withdrawing detachable parts, said system comprising two flaps connected by a common fold line, said system comprising a tab that extends longitudinally and is detachably connected along a transverse precut line to one of the flaps on an outer edge thereof, the width of the tab, measured transversely, being smaller than that of the flap.

Various additional characteristics can be foreseen, alone or in combination:

- the width of the tab is between one-half and one-fourth of the width of the flap;
- the width of the tab is equal to approximately two-fifths of the width of the flap;
- the tab is connected to the flap by a widened inner end section;
- the tab has a widened outer end section;
- the system comprises, on the side opposite the tab, a tongue that is detachably connected along a transverse precut line to the other flap on an outer edge thereof;
- the tongue comprises an outer end section defining a tip;
- the tongue is connected to the flap by a widened inner end section;
- the system comprises appendices that are detachably connected to the flaps along the longitudinal precut lines;
- the system integrates an RFID chip attached to one of the flaps.

Other objects and advantages of the invention will be seen from the following description of a preferred embodiment, provided with reference to the appended drawings in which.

Figure 1:
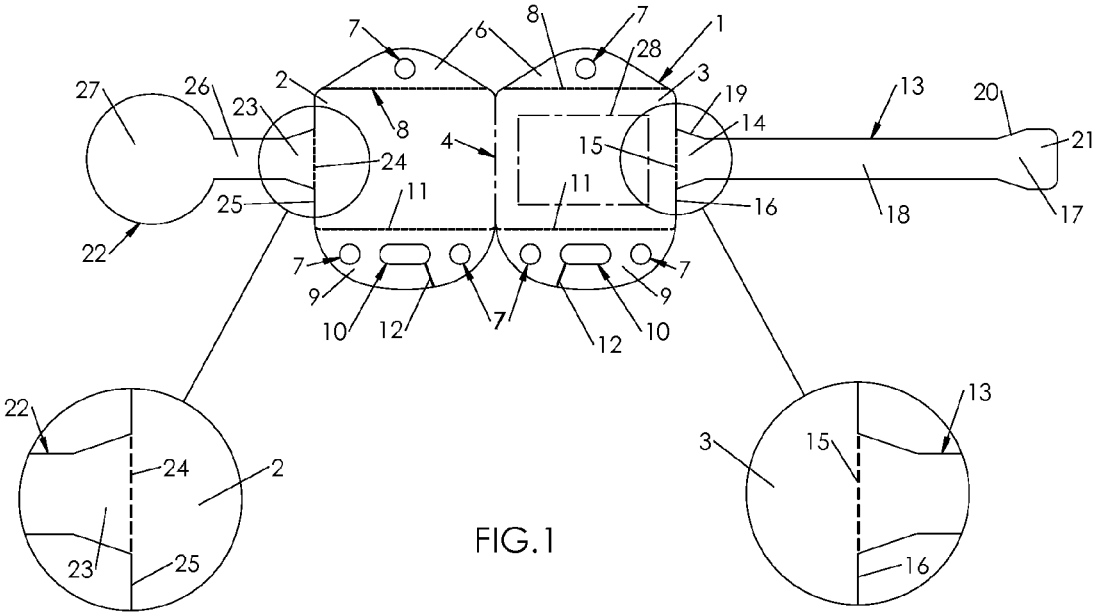
FIG. 1 is a plan view of an individual tagging system according to a first embodiment.

Represented in FIG. 1, according to a first embodiment, is a tagging system 1 of the three-in-one type, integrating three different tags that can be removed as needed depending on the type of item to be tagged.

The system 1 is presented in the form of a cut sheet, a front face (visible in FIG. 1) being printable, and a rear face (opposite to the front face, and therefore not visible) being coated over substantially all of its surface, except for zones that will be specified hereinafter. The system 1 is longer than it is wide; in the following, its principal direction of extension is considered "longitudinal," corresponding to the length of the system 1, and "transverse" refers to the perpendicular direction corresponding to the width of the system 1.

As can be seen in FIG. 1, the system 1 comprises two flaps, substantially rectangular in shape, that is, a left flap 2 and a right flap 3 joined by a common transverse central edge 4 forming a rectilinear fold line. The left flap 2 and/or the right flap 3 is provided with an inscription 5 recorded by printing, comprising for example a reference corresponding to the item to be tagged and the price, with the possible addition of signs (such as a barcode or a two-dimensional tag) that can be read by optical means (such as a barcode or tag reader).

Each flap 2, 3 has, at the top, an upper appendix 6 substantially triangular in shape, rounded off at the top, in which a circular cut 7 is made defining a disk of detachable material that, when pushed out, leaves a circular hole free for the passage of a rod or loop of an item to be tagged. The upper appendix 6 is separated from the adjoining flap 2, 3 by a rectilinear longitudinal cut line 8 that forms an upper edge of the flap 2, 3 when the upper appendix 6 is detached therefrom.

Each flap 2, 3 is further extended, at a lower edge, by a lower appendix 9 substantially elliptical or oval in shape, in which several cuts are made, in this instance a central cut 10 of oblong shape defining a tab of material, flanked on either side by two circular cuts 7 each defining a disk of detachable material. By pushing out said tab, respectively said disk, an oblong, respectively circular hole is left free for the passage of a rod or loop of an item to be tagged. The lower appendix 9 is separated from the adjoining flap 2, 3 by a rectilinear longitudinal cut line 11 (except for its rounded ends), which forms a lower edge of the flap 2, 3 when the lower appendix is detached therefrom.

As can be seen in FIG. 1, each lower appendix 9 can be further provided with a slot 12 that connects the oblong cutout 10 to a free edge of the appendix, so as to allow the possible passage of a closed loop of an item (such as a medallion of a chain or a loop of a pendant). The slot 12 extends obliquely (the slots 12 of the left flap 2 and of the right flap 3 being symmetrical with respect to the central fold line 4, so that they are superimposed when the flaps 2, 3 are folded onto each other), although said slot could be extended transversely.

The system 1 further comprises a tab 13 having no inscription, which extends longitudinally towards the right from the right flap 3. More specifically, the tab 13 has an inner end section 14 by which the tab 13 is connected to the right flap 3 by a rectilinear transverse precut line 15 located around the middle of an outer edge 16 of the right flap 3, and an opposite outer end section 17.

The tab 13 is narrow, its width being much smaller than its length (in a ratio of about 1 to 10). Moreover, the tab 13 is narrower than the flap 3, and more specifically, its average width is between one-half and one-fourth the width of the flap 3.

The length of the precut line 15 (measured transversely) is between one-third and two-thirds of the width of the flap 3 (that is, of the length, measured transversely, of its outer edge 16).

According to a preferred embodiment, illustrated in FIG. 1, the tab 13 is widened at both ends: consequently, it has a widened inner end section 14 and a widened outer end section 17, which flank a central section 18 that is relatively narrower, has parallel rectilinear edges and a rear face that is not coated (unlike the end sections 14, 17, which are coated on the rear face). The precut line 15 has a length of about two-fifths of the length of the outer edge 16 of the flap 3.

The end sections 14, 17 are, for example, trapezoidal in shape, delimited transversely by the sloped edges 19, 20 together forming a V, the sloped edges 19 of the inner end section 14 opening towards the left and the sloped edges 20 of the outer end section 17 opening symmetrically towards the right.

As can be seen in FIG. 1, the outer end section 17 comprises, in the extension of the sloped-edges portion 20, a portion 21 of rectangular shape.

The system 1 further comprises, opposite the tab 13, a tongue 22 that extends longitudinally towards the left from the left flap 2. More specifically, the tongue 22 has an inner end section 23, by which the tongue 22 is connected to the left flap 2 by a rectilinear transverse precut line 24 located around the middle of an outer edge 25 of the flap 2, a central section 26, and at an outer end, a tip 27, the width of which (that is, the transverse dimension) is larger than the width of the central section 26. The tip 27 can have any shape, but according to a preferred embodiment illustrated in FIG. 1, said shape is circular. The central section 26 is not coated on the rear face.

The tongue 22 is narrower than the left flap 2, including at the tip 27.

The central section 26 has, for example, the same width as the central section 18 of the tab 13. According to one preferred embodiment illustrated in FIG. 1, the tongue 22 has a widened inner end section 23, symmetrical with the inner end section 14 of the tab 13. The length of the precut line 24 (measured transversely) is between one-third and two-thirds of the width of the flap 2 (that is, of the length, measured transversely, of its outer edge 25), and for example is substantially equal to two-fifths of said length.

One of the two flaps (for example the right flap 2, as illustrated in the drawings) can also be provided with an RFID-type chip 28 (in broken lines in the drawings), attached by adhesive bonding to the rear face.

Figure 2:
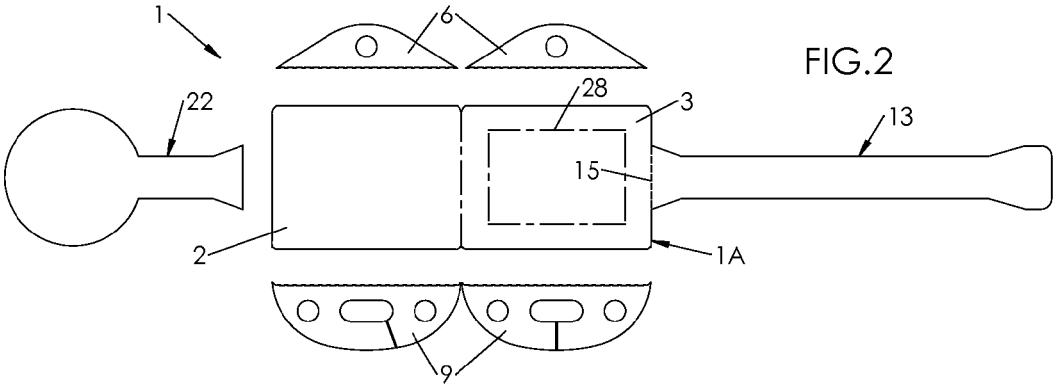
FIG. 2 is a plan view of the system of FIG. 1, the detachable elements of which are separated for the removal of a first tag intended for tagging a first family of items such as bands and rings.

Represented in FIG. 2 is the removal from the system of a first tag 1A intended for tagging an item 29 of a first family, in this instance a ring. To obtain this first tag 1A, the upper appendix 6 and lower appendix 9 are removed by detaching them from the flaps 2, 3 along the longitudinal precut lines 8, 11, and the tongue 22 is removed by being detached from the left flap 2 along the transverse precut line 24, said first tag 1A therefore being composed of two adjacent flaps 2, 3, joined by the central fold line 4, and the tab 13, which remains attached to the right flap 3.

Figure 3:
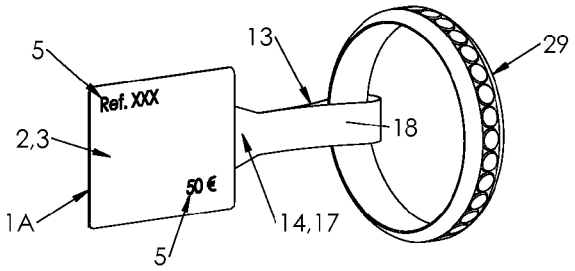
FIG. 3 is a view in perspective illustrating one possible use of the first tag on a ring.

In order to tag the item, the tab 13 is threaded into one part of the item (in this instance a ring 29, as illustrated in FIG. 3), then is folded onto itself around the item to form a loop, folding the outer end section 17 onto the inner end section 14 of the rear face, so that the sloped sides 19, 20 are joined together, the rectangular end portion 21 of the tab 13 being applied against the rear face of the right flap 3.

Then, by folding the left flap 2 onto the rear face of the right flap 3, the rectangular end portion 21 of the tab 13 is confined between the flaps 2, 3 and can only be removed by a strong pull. The chip 28 is also confined between the flaps 2, 3. The tag 1A is attached in this way to the item 29, as illustrated in FIG. 3.

Because the rear face of the central section 18 of the tab 13 is not coated, the tab 13 can slide freely on the item 29, so that it can be placed in any desired position depending on the shape of the item 29 and the display needs.

Figure 4:
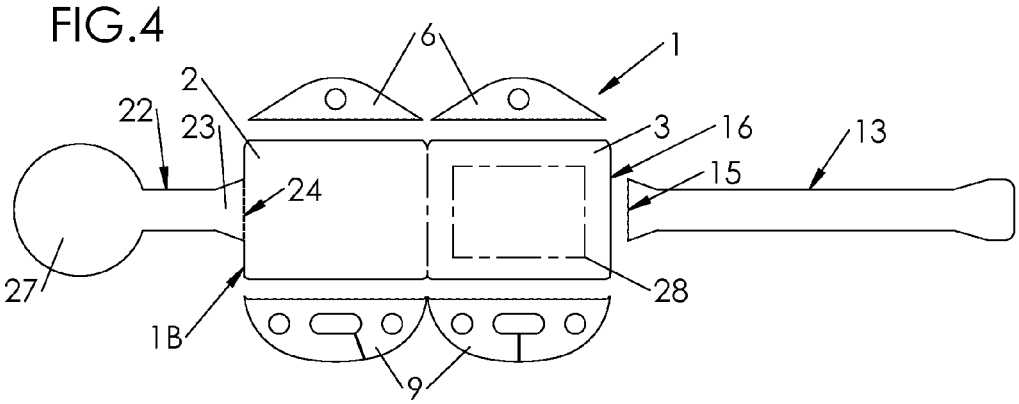
FIG. 4 is a plan view of the system of FIG. 1, the detachable elements of which are separated for the removal of a second tag intended for tagging a second family of items such as wristwatches.

Represented in FIG. 4 is the removal from the system 1 of a second tag 1B intended for tagging an item of a second family, in this instance a wristwatch 30. To obtain said second tag 1B, the upper appendix 6 and lower appendix 9 are removed by detaching them from the flaps 2, 3 along the longitudinal precut lines 8, 11, and the tab 13 is removed by detaching it from the right flap 3 along the transverse precut line 15, said second tag 1B therefore being composed of the two adjacent flaps 2, 3, joined at the central fold line 4, and of the tongue 22 that remains attached to the left flap 2. The flaps 2, 3 are folded onto each other, thus confining the chip 28.

Figure 5:
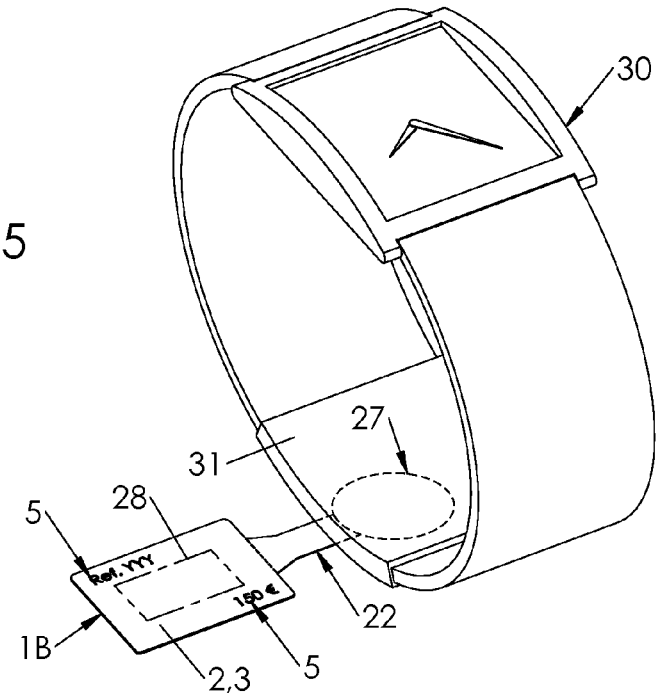
FIG. 5 is a view in perspective illustrating one possible use of the second tag on a wristwatch.

In order to tag the item 30, the coated side of the tip 27 is positioned, then applied to a portion of the item of sufficient surface area, and of appropriate material for the adhesive. Wristwatches with a metal bracelet, as well as some wristwatches with a leather bracelet, are generally fitted with a metal clasp 31, beneath which (in the position of display of the wristwatch, as illustrated in FIG. 5) the tip can be adhered, the display part of the tag 1B (that is, the flaps 2, 3) extending out of the bracelet. It is also possible to adhere the tag 1B by applying the tip against a lower face of the watch case 30. Since the wristwatch is generally hung on an annular display, there is little risk that the tip 27 will come off.

Figure 6:
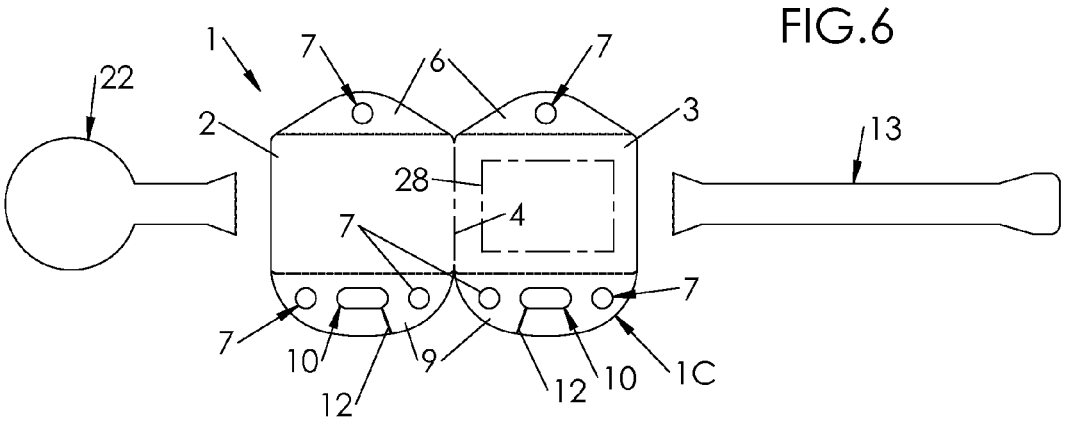
FIG. 6 is a plan view of the system of FIG. 1, the detachable elements of which are separated for the removal of a third tag intended for tagging a third family of items such as pendants, chains, necklaces, bracelets.

Represented in FIG. 6 is the removal from the system 1 of a third tag 1C intended for tagging an item of a third family, in this instance a pair of earrings 32. To obtain said third tag, the tab 13 is removed by detaching it from the right flap 3 along the precut line 15 and the tongue 22 is removed by detaching it from the left flap 2 along the cut line 24, said third tag 1C being therefore composed of the two adjacent flaps 2, 3, and of the upper appendix 6 and lower appendix 9 that remain attached to them.

Figure 7:
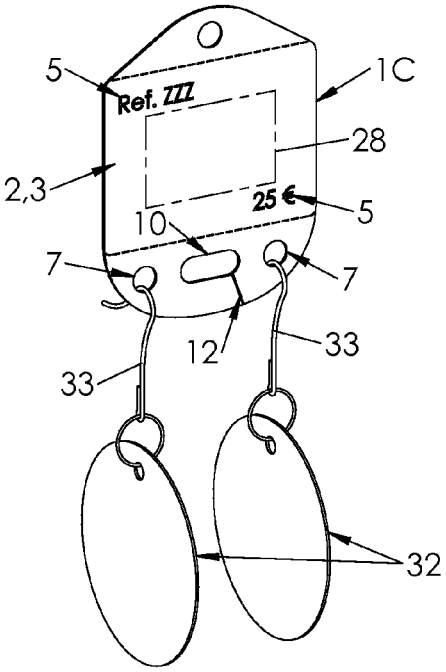
FIG. 7 is a view in perspective illustrating one possible use of the second tag on a pair of earrings.

The flaps 2, 3 with the appendices 6, 9 are then folded onto each other. The chip 28 is thus confined between the flaps 2, 3. To proceed with the tagging, the loops 33 of the items are inserted into the holes provided in the appendices, either by pushing out the precut disks or tabs, as illustrated in FIG. 7 showing the tagging of a pair of earrings 32, each provided with a loop 33 formed by a twisted metal wire inserted into a hole 7, or by inserting the loops 33 obliquely (or transversely) into the slots 12 until they are lodged in the oblong hole 10.

Figure 8:
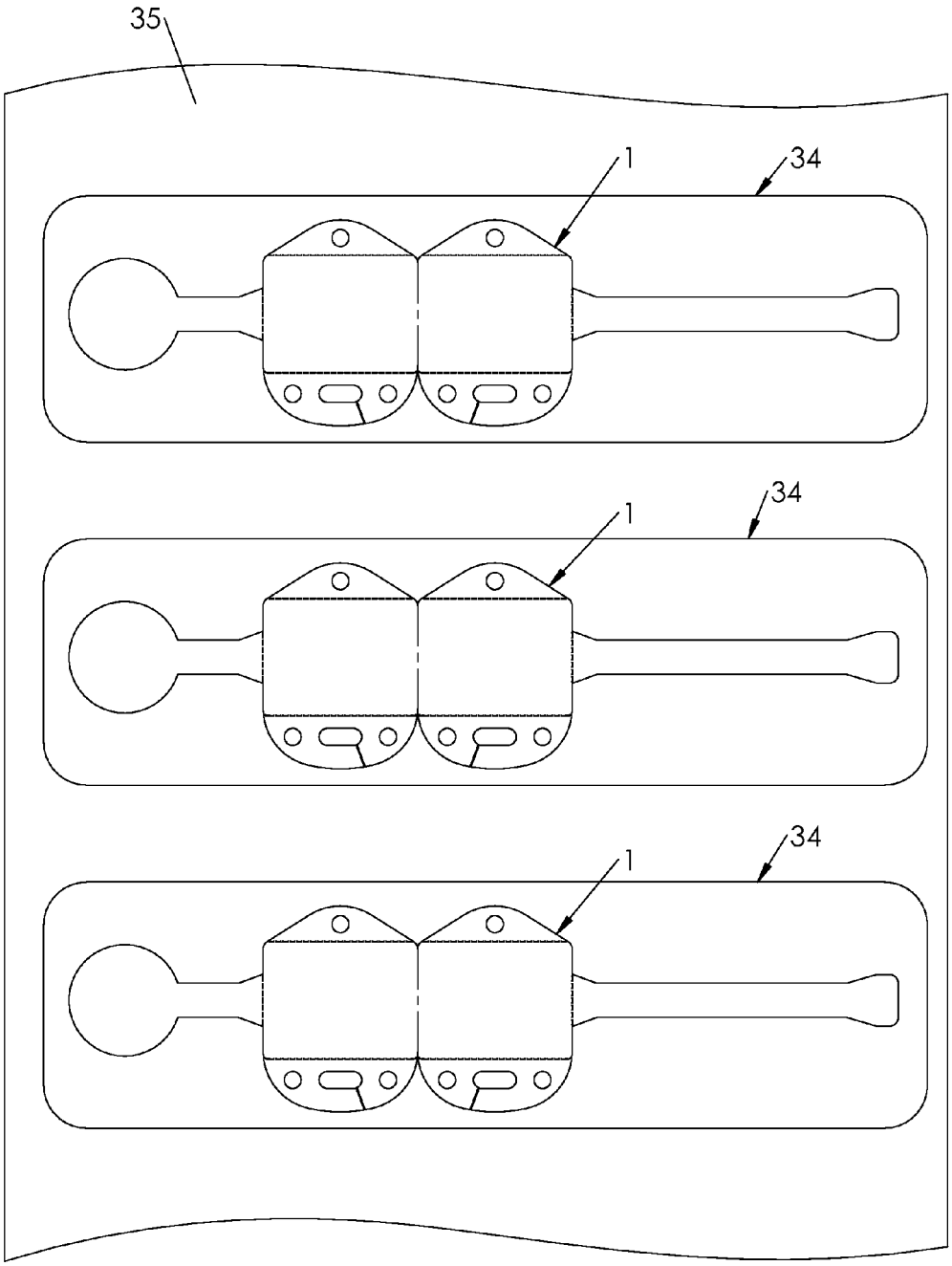
FIG. 8 is a plan view illustrating the mass production of a tagging system as represented in FIG. 1.

As illustrated in FIG. 8, the tagging system 1 can be produced in the conventional way, by cutting strips 34 of coated paper, peelably positioned in series on a support 35 of anti-adhesive surface (for example sulfurized paper), in windable format appropriate for continuous feeding to a printer.

The system that has just been described has the following advantages.

First, the system 1 is universal at least in the domain of tagging jewelry, because as a result of the three tags 1A, 1B, 1C of which it is comprised, it is possible to directly tag all types of jewelry without the need to have additional elements (such as a wire). The result is great efficiency in tagging.

Second, because the two printable flaps 2, 3 are common to all of the tags 1A, 1B, 1C of the system 1, the printing of the information is reduced to a single procedure (except of course for the contents of the information itself, which can vary from one item to another), which simplifies the manufacture of the tags by standardizing it.

Third, because the precut lines 8, 11, 15, 24 are rectilinear, the detachment of the different parts is quick and easy, without the risk of accidental detachment of a part intended to remain attached to one of the flaps 2, 3. This considerably reduces the risks of incorrect use, and contributes to the efficiency of the tagging.

Fourth, the respective transverse cut lines 15, 24 of the tab 13 and of the tongue 22 are both long enough to have sufficient resistance to being accidentally torn off when they are intended to remain attached to the flaps 2, 3 for the requirements of the tagging (respectively of a ring and of a wristwatch), and short enough to facilitate and accelerate their voluntary detachment in order to obtain, respectively of the second tag 1B (without the tab 13) and of the first tag 1A (without the tongue 22), or to obtain the third tag 1C (without the tab 13 and the tongue 22). The length relationships recommended above make it possible to optimize the compromise between passive resistance and ease of voluntary detachment.

Numerous variants can be proposed.

Figure 9:
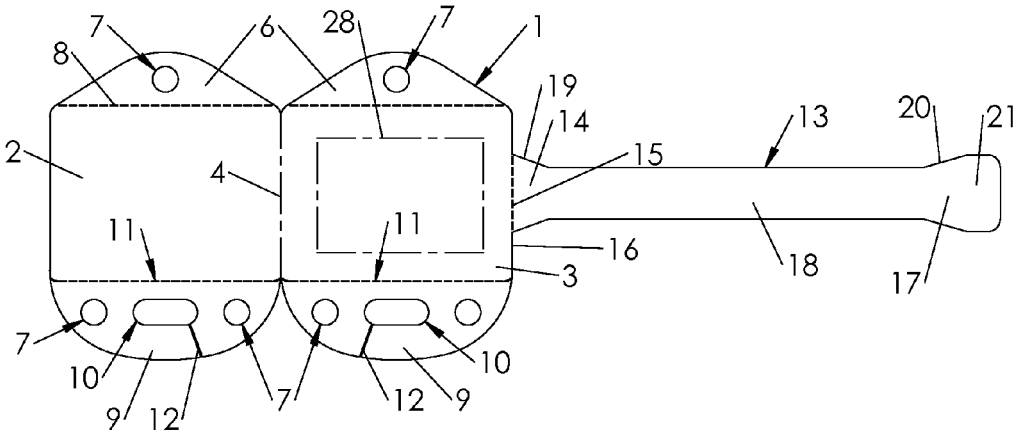
FIG. 9 is a plan view of an individual tagging system according to a second embodiment.

Thus, represented in FIG. 9 is a second embodiment of the system 1, which is distinguished from the first embodiment only by the absence of a tongue, the flaps 2, 3, the appendices 6, 9, and the tab 13 remaining unchanged. It is understood that this system 1 includes the first tag 1A and the third tag 1C described above, which can be removed in the same way.

Figure 10:
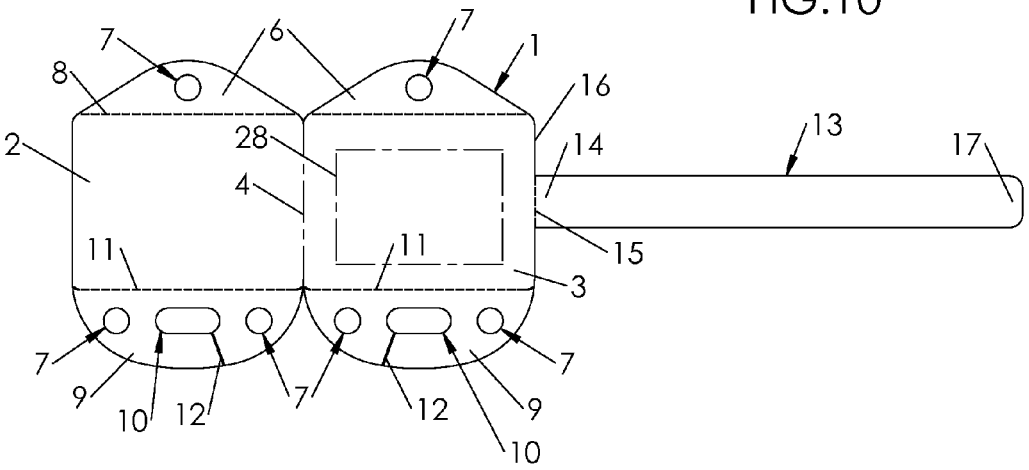
FIG. 10 is a plan view of an individual tagging system according to a third embodiment.

Represented in FIG. 10 is a third embodiment of the system 1, which is distinguished from the second embodiment by the absence of widening of the tab 13, which is therefore rectilinear.

Like the second embodiment, this third embodiment includes the first tag 1A and the third tag 1C, which can be removed in the same way. The strength of the tab 13 is less than that of the first and second embodiments, but it can be considered sufficient for most applications.

The invention claimed is:

1. A system of tagging items that integrates at least two tags of different shapes, each of which can be removed by withdrawing detachable parts, said system comprising two flaps connected by a common fold line, wherein the system comprises a tab that extends longitudinally and is detachably connected along a transverse precut line to corresponding one of the flaps on an outer edge thereof, the width of the tab, measured transversely, being smaller than that of the corresponding flap; wherein the system comprises an upper appendix and a lower appendix, and wherein at least one of the upper appendix or the lower appendix has at least one circular cut; and wherein the system further comprises on the side opposite the tab, a tongue that is detachably connected, along a transverse precut line, to the other of the flaps on an outer edge thereof.

2. The tagging system according to claim 1, characterized in that the width of the tab is between one-half and one-fourth the width of the corresponding flap.

3. The tagging system according to claim 2, characterized in that the width of the tab is equal to approximately two-fifths of the width of the corresponding flap.

4. The tagging system according to claim 1, characterized in that the tab is connected to the corresponding flap by a widened inner end section.

5. The tagging system according to claim 4, characterized in that the tab has a widened outer end section.

6. The tagging system according to claim 1, characterized in that the tongue comprises an outer end section defining a tip.

7. The tagging system according to claim 1, characterized in that the tongue is connected to the other of the flaps by a widened inner end section.

8. The tagging system according to claim 1, wherein the upper appendix and the lower appendix are detachably connected to the flaps along longitudinal precut lines.

9. The tagging system according to claim 1, further comprising an RFID chip attached to one of the flaps.

10. The tagging system according to claim 1, wherein each of the upper appendix and the lower appendix has a circular cut.

11. A system of tagging items that integrates at least two tags of different shapes, each of which can be removed by withdrawing detachable parts, said system comprising a first flap and a second flap connected by a common fold line, wherein the system comprises a tab that extends longitudinally and is detachably connected along a transverse precut line to the first flap on an outer edge thereof, the width of the tab, measured transversely, being smaller than that of the first flap; the system further comprising on the side opposite the tab, a tongue that is detachably connected, along a transverse precut line to the second flap on an outer edge thereof.

12. The system of tagging according to claim 11, wherein the width of the tab is between one-half and one-fourth the width of the first flap.

13. The system of tagging according to claim 11, wherein the width of the tab is equal to approximately two-fifths of the width of the first flap.

14. The system of tagging according to claim 11, wherein the tab is connected to the first flap by a widened inner end section.

15. The system of tagging according to claim 14, wherein the tab has a widened outer end section.

16. The system of tagging according to claim 11, wherein the tongue comprises an outer end section defining a tip.

17. The system of tagging according to claim 11, wherein the tongue is connected to the second flap by a widened inner end section.

18. A system of tagging items that integrates at least two tags of different shapes, each of which can be removed by withdrawing detachable parts, said system comprising a first flap and a second flap connected by a common fold line, wherein the system comprises a tab that extends longitudinally and is detachably connected along a transverse precut line to the first flap on an outer edge thereof, the width of the tab, measured transversely, being smaller than that of the first flap; and wherein the system comprises an appendix attached to one side of one of the first flap or the second flap by a precut line, the appendix extending away from the corresponding attached flap in a direction transverse to a longitudinal direction of the system, the appendix having a through hole; and wherein the system further comprises on a side opposite the tab, a tongue that is detachably connected, along a transverse precut line, to the second flap on an outer edge thereof.

19. The system according to claim 18, further comprising a second appendix attached by a precut line to another side of the first flap or the second flap of one of the two flaps, the second appendix extending away from the corresponding attached flap in a direction transverse to a longitudinal direction of the system, the second appendix having a through hole.

* * * * *